US007514871B2

(12) United States Patent
Scholl et al.

(10) Patent No.: US 7,514,871 B2
(45) Date of Patent: Apr. 7, 2009

(54) HIGH-PRESSURE GAS-DISCHARGE LAMP WITH IMPROVED TEMPERATURE RESISTANCE

(75) Inventors: Robert Peter Scholl, Roetgen (DE); Rainer Hilbig, Aachen (DE); Achim Gerhard Körber, Kerkrade (NL); Johannes Baier, Würselen (DE); Klaus Gawron, Aachen (DE); Dieter Leers, Stolberg (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 424 days.

(21) Appl. No.: 10/529,690

(22) PCT Filed: Sep. 23, 2003

(86) PCT No.: PCT/IB03/04156

§ 371 (c)(1),
(2), (4) Date: Mar. 29, 2005

(87) PCT Pub. No.: WO2004/032181

PCT Pub. Date: Apr. 15, 2004

(65) Prior Publication Data

US 2005/0253521 A1 Nov. 17, 2005

(30) Foreign Application Priority Data

Oct. 2, 2002 (DE) ..... 102 45 922

(51) Int. Cl.
*H01J 17/18* (2006.01)
*H01J 5/46* (2006.01)

(52) U.S. Cl. ..... 313/623; 313/624; 313/625; 313/626; 313/636; 313/318.01

(58) Field of Classification Search ..... 313/623
See application file for complete search history.

(56) References Cited

U.S. PATENT DOCUMENTS

| | | | | |
|---|---|---|---|---|
| 3,105,867 | A | 10/1963 | Meijer | |
| 3,753,026 | A * | 8/1973 | Goorissen | 313/318.12 |
| 5,021,711 | A | 6/1991 | Madden et al. | |
| 6,265,817 | B1 | 7/2001 | Steinmann et al. | |
| 6,624,576 | B1 * | 9/2003 | Mittler | 313/623 |
| 6,777,875 | B1 * | 8/2004 | Steinman et al. | 313/623 |
| 2003/0052608 | A1 * | 3/2003 | Morimoto et al. | 313/633 |
| 2003/0102805 | A1 * | 6/2003 | Hataoka et al. | 313/623 |

FOREIGN PATENT DOCUMENTS

DE 196 03 300 C2 7/1997

(Continued)

OTHER PUBLICATIONS

English machine translation of JP 2002-260581 to Kamimura et al.*

*Primary Examiner*—Sikha Roy

(57) ABSTRACT

The invention relates to a high-pressure gas-discharge lamp, having at least one gastight fused press-seal between a glass-like material and molybdenum, wherein the molybdenum in the fused press-seal is at least partly exposed to an oxidizing environment and at least that part of the molybdenum that is exposed to the oxidizing environment is covered with a coating, and the coating comprises at least one oxide from among $Fe_2O_3$, $Ta_2O_5$, $Nb_2O_5$, $Al_2O_3$, $SiO_2$, $TiO_2$, $ZrO_2$, $HfO_2$, and/or one nitride from among TiN, ZrN, HfN, AlN, BN, and/or one carbide from among TiC, ZrC, HfC, VC, NbC, TaC, $B_4C$.

7 Claims, 1 Drawing Sheet

FOREIGN PATENT DOCUMENTS

| | | | | |
|---|---|---|---|---|
| JP | 63021739 | A | * | 1/1988 |
| JP | 2001102008 | A | * | 4/2001 |
| JP | 2002260581 | A | * | 9/2002 |
| WO | WO0126129 | A1 | | 4/2001 |

* cited by examiner

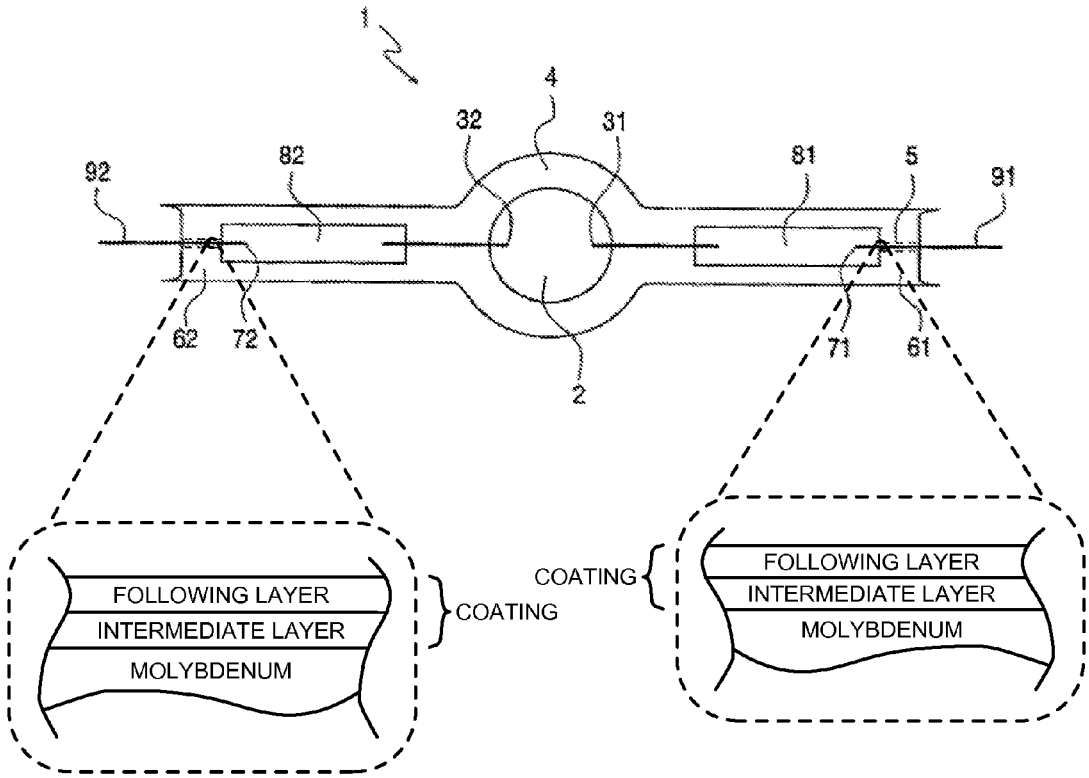
1
4
32
31
92
82
81
5
91
62
72
71
61
2
FOLLOWING LAYER
INTERMEDIATE LAYER
MOLYBDENUM
COATING
COATING
FOLLOWING LAYER
INTERMEDIATE LAYER
MOLYBDENUM

HIGH-PRESSURE GAS-DISCHARGE LAMP WITH IMPROVED TEMPERATURE RESISTANCE

The invention relates to a high-pressure gas-discharge lamp, having at least one gastight fused press-seal between a glasslike material and molybdenum, wherein the molybdenum in the fused press-seal is at least partly exposed to an oxidizing environment and at least that part of the molybdenum that is exposed to the oxidizing environment is covered with a coating.

Because of their optical properties, there is a preference for using high-pressure gas-discharge lamps (HID (high-intensity discharge) lamps), of the kind used for projection purposes, for overhead projection and as spotlights. Examples of high-pressure gas-discharge lamps of this kind are so-called UHP or MSR lamps (Philips), although comparable lamps made by other manufacturers are also covered by the invention. The lamp vessel of high-pressure gas-discharge lamps of this kind is preferably composed of quartz or high-temperature glass. The lamp vessel usually has at least two molybdenum feedthroughs, which ensure that the lamp vessel is closed off in a gastight manner and make it possible for the light-generating means arranged in the interior of the lamp vessel to be supplied with electrical voltage.

The actual application of the energy is generally performed by internal electrodes, which are preferably composed of tungsten. In the outward direction, the electrodes are normally connected to an external ballast via molybdenum. The molybdenum is usually in the form of a molybdenum foil or ribbon or molybdenum wire. The gastight seal is usually produced by as least one gastight fused press-seal between the glasslike material, generally quartz, and molybdenum. The fused press-seal may in a known manner be designed as a so-called pinch seal or as a fused molybdenum press-seal. Because the coefficients of thermal expansion of quartz glass and molybdenum are very different, it is imperative for the molybdenum in the fused press-seal to be able to shrink when wide variations in temperature occur, e.g. during cooling after the fused press-seal has been made. Overall, the gastight seal at the fused press-seal is ensured by the sizing of the molybdenum, and particularly of the molybdenum foil, and that of the fused press-seal. A part of the molybdenum, which extends away from the discharge chamber, is however exposed to an oxidizing environment even wide the fused press-seal. In this region of the fused press-seal, which is exposed to an oxidizing environment, the temperature of the molybdenum has to be less than 350° C. while the lamp is operating, in order to prevent any increased, material-related increase in the oxidation of the molybdenum, i.e. generally of the molybdenum wire. The temperature of the molybdenum in the particular case decreases with increasing distance—away from the discharge chamber—in the longitudinal direction. If the temperature regime of the particular lamp, and the dimensions of the gastight fused press-seal, and particularly the longitudinal distance for which the molybdenum extends in the fixed joint, are known, then the requisite minimum length can be determined for the fused press-seal.

In a commercially available UHP lamp (120 W type) for example, the longitudinal extent of this region is approximately 3 cm, with the longitudinal extent of the region of the lamp vessel in which the discharge chamber is arranged being approximately 0.9 cm. Sizing of this nature that has been necessary hitherto for the longitudinal extent of the fused press-seal is a disadvantage in certain applications. In connection with ongoing development and the opening up of new areas of application, the market has a need for high-pressure gas-discharge lamps of smaller dimensions but comparable power, or of comparable dimensions but of greater power or having fused press-seals of greater temperature resistance.

There are different proposed solutions known from the literature for increasing the oxidation resistance and hence the temperature resistance of molybdenum. One approach to a solution (see DE 196 03 300 amongst others) is directed towards improving the oxidation resistance of molybdenum, in an electric lamp having molybdenum foil feedthroughs for a quartz lamp vessel, by doping. As an alternative, it is proposed in the literature that a coating that increases at least the oxidation resistance of molybdenum be applied to the surface of the molybdenum. There are no materials available that give a reliable guarantee in practice of a temperature resistance of at least greater than 450° C. of the kind that is desirable for high-pressure gas-discharge lamps.

Known from U.S. Pat. No. 5,021,711 is a quartz lamp whose molybdenum wires, which are situated outside the pinch seal, are coated, and in which the molybdenum that is situated within the pinch seal, which may in particular be in the form of a molybdenum foil, is enriched with oxidation-inhibiting materials in the surface region of the molybdenum. The enrichment is performed by means of expensive incorporation by ion implantation, which means that, as is not usual in the case of coatings, there is no increase in the thickness of the layer of molybdenum foil. The oxidation-inhibiting materials concerned are selected from the group comprising chromium, aluminum, silicon, titanium, tantalum, palladium, and mixtures thereof. What are disclosed as materials that are applied to the external molybdenum wires by coating by the so-called PCVD (plasma-enhanced chemical vapor deposition) process are silicon nitrides and/or silicon carbides.

According to U.S. Pat. No. 5,021,711, coating of the molybdenum that is situated within the gastight pinch seal was not considerably feasible in technical terms because many attempts at this had been made by those skilled in the art but, for different reasons, had not up to then met with any success when applied in practice. It requires separate increases in the oxidation resistance of those parts of the molybdenum that are situated inside and outside a pinch seal in a lamp and this is a complicated and expensive process.

It is an object of the invention to provide a high-pressure gas-discharge lamp of the kind described in the opening paragraph, and a lighting device and/or projection device having a high-pressure gas-discharge lamp of this kind, that has a gastight fused press-seal that contains at least coated molybdenum, thus giving the lamp improved properties and allowing it to be effectively manufactured in an industrial production context.

The object of the invention is achieved by virtue of the fact that the coating comprises at least one oxide from among $Fe_2O_3$, $Ta_2O_5$, $Nb_2O_5$, $Al_2O_3$, $SiO_2$, $TiO_2$, $ZrO_2$, $HfO_2$, and/or one nitride from among TiN, ZrN, HfN, AlN, BN, and/or one carbide from among TiC, ZrC, HfC, VC, NbC, TaC, $B_4C$.

By the selection according to the invention of the materials suitable as coatings for molybdenum that meet the requirements relating to increased temperature resistance and can be produced by the usual industrial coating processes such as the PCVD or CVD process, there are obtained improved properties for the high-pressure gas-discharge lamps according to the invention and for lighting devices of which the latter form functional components. A coating composed of the proposed materials ensures that adequate temperature resistance will exist throughout the entire life of the lamp, at least in the range from 350° C. to 600° C. The selected materials likewise need to be of adequate temperature resistance. One measure of this is the melting point of the material, which should regularly be above the softening temperature of the glass-like material, such as quartz, for example. Also, their coefficient of thermal expansion should, as far as possible, be the same as that of molybdenum (4.8 ppm/K), in order to reduce the occurrence of thermal stresses and strains between the molybdenum and the coating to the greatest possible degree.

An increased temperature resistance according to the invention is advantageous in comparison with a conventional high-pressure gas-discharge lamp in applications in which there have to date been restrictions relating to the installed position. Certain projection lamps can, for example, be operated only in a horizontal installed position at the moment. Installation in a vertical position would cause excessively high temperatures to occur at the top end of a twin-cap high-pressure gas-discharge lamp and these could result in its being badly damaged. A higher temperature resistance overcomes these restrictions, which also makes possible new degrees of freedom in the styling of lighting and/or projection devices when use is made of the lamp according to the invention.

Alternatively, the invention makes it possible, in a proportion of projection devices in which it has so far been essential for components to be provided to monitor the temperature of the lamp and cool it, for the cost and complication that this involves to at least be reduced.

Generally speaking, the possibility may now also exist, in lamps that so far have had to be operated in an outer envelope filled with an inert gas for reasons of anticorrosion protection, of dispensing with this outer envelope, the invention therefore also relating to high-pressure gas-discharge lamps having an outer envelope.

Particularly advantageous embodiments of the invention are described in the dependent claims.

In one embodiment of the invention, it is preferable for the coating to have a film thickness of from 5 nm to 20 μm, in which case a film thickness of from 100 nm to 20 μm has proved particularly useful in the context of industrial production. Basically, thin films within the above range are to be preferred, though on the other hand an attempt has to be made to obtain a closed film, something that is easier to ensure in technical terms with a higher film thickness within the preferred range.

It is also preferable for the coating itself to be built up from a plurality of layers. When this is the case it is possible for the layers, which in themselves should be as homogenous and gastight as possible, to be given different functions, film thicknesses and/or chemical compositions. The layer that is applied directly to the molybdenum may, for example, act as a protective layer. This latter ensures, in particular, that the chemically corrosive process gases that occur in the case of, for example, a CVD coating are unable to react directly with the molybdenum. When there are a plurality of layers present, the intermediate layer or layers help to reduce thermal stresses and strains of the kind that regularly result from the different thermal expansion characteristics of molybdenum and the materials in the coating when there are variations in temperature. This may, for example, be done by, when there are two layers, with the outer layer formed from $Al_2O_3$ and the intermediate layer composed of a mixture of nitrides (N) and carbides (C) of titanium (Ti), selecting the quantitative ratio of N to C in such a way that the coefficient of thermal expansion of the intermediate layer assumes a value that is between that of molybdenum (4.8 ppm/K) and that of $Al_2O_3$ (8 ppm/K).

As an alternative, it is preferable for the layer that is applied directly to the molybdenum preferably to be composed of AlN (4-5 ppm/K) or $Ta_2O_5$ (2.8 ppm/K).

Surprisingly, the use of $Al_2O_3$ produces a coating that is particularly suitable for the purposes of the invention, even though the coefficient of thermal expansion of $Al_2O_3$ (8 ppm/K) differs relatively widely from that of molybdenum (4.8 ppm/K).

A particular embodiment of the invention makes it possible for the fused press-sealing to be reduced to the amount that is necessary for the purposes of temperature resistance, because the smallest possible sizing for the fused press-seal, and particularly for the longitudinal extent of that part of the molybdenum that is not exposed to an oxidizing environment, can be obtained as a function of the particular material of which the coating is composed.

By reason of the coating of molybdenum in accordance with the invention, the length of the fused press-seal can be appreciably shortened, because the temperature, when the lamp is operating, of that end of the lamp that is exposed to an oxidizing environment can be raised to 350° C. to 600° C. With the reduction in the length of the fused press-seal that the invention makes possible, there is also a regular reduction in the size of the burner of the high-pressure gas-discharge lamp. This makes it possible for a plurality of new lamp designs, such as, for example, lamps of smaller dimensions but the same power or lamps of the same dimensions but higher power, to be made available. The cost of materials and production for a burner having at least one fused press-seal according to the invention, and also for other components such as, for example, the reflector, can be significantly reduced. A fused press-seal of smaller size also absorbs and scatters less light while the lamp is operating, thus improving the quality of light from the lamp or from the reflector.

It is precisely in the case of lamps of comparatively low power that efficiency too is increased, because less material has to be heated to raise the lamp to the requisite operating temperature. At the same time, the heat losses due to thermal conduction or radiation are reduced due to the reduction that is possible in the surface area of the lamp.

A further aspect of the invention relates to the use of the high-pressure gas-discharge lamp according to the invention as claimed in at least one of claims 1 to 7 for projection purposes.

The improvements that can be achieved with the high-pressure gas-discharge lamp according to the invention make the said lamp predestined for the above-mentioned uses. Particular advantages for known and new applications are afforded by the increased temperature resistance. Certain projection lamps of the high-pressure gas-discharge type that, for example, can only be operated in a horizontal installed position at the moment are now no longer subject to this installation-related restriction. A reduction in the size of the lamp, something that currently forms the focus of the worldwide development work being done on high-pressure gas-discharge lamps for projection purposes, has disproportionately significant effects in projection applications as compared with other fields in which use is made of high-pressure gas-discharge lamps.

The object of the invention is also achieved by lighting devices and/or projection devices that comprise at least one high-pressure gas-discharge lamp as claimed in at least one of claims 1 to 7.

A reduction in the size of the lamp, or an increase in its efficiency, produces disproportionately significant effects as compared with other devices in which the high-pressure gas-discharge lamp according to the invention can be used. The invention makes possible entirely new degrees of freedom in the styling and design of lighting devices and/or projection devices for existing and new applications, and at the same time satisfies a pressing demand from the market.

These and other aspects of the invention are apparent from and will be elucidated with reference to the embodiments described hereinafter.

In the drawings:

FIG. 1 is a schematic representation of a lamp envelope, which has a discharge chamber and belongs to a high-pressure gas-discharge lamp (a UHP lamp).

FIG. 1 is a diagrammatic representation in section of a lamp envelope 1, having a discharge chamber 2, of a high-pressure gas-discharge lamp (a UHP lamp) according to the invention. The lamp envelope 1 is all in one piece, seals off hermetically the discharge chamber 2 that is filled with a gas usually employed for this purpose, and its material is usually quartz glass, and it comprises two cylindrical regions situated opposite one another occupied by fused press-seals 61, 62 that are each of an extent in the longitudinal direction of approximately 30 mm, between which cylindrical regions is situated a substantially spherical region 4 having a diameter of approximately 9 mm. Part of the molybdenum 5, namely at least part of the molybdenum ribbons 81, 82 that extend away from the discharge chamber 2, and at least parts of the molybdenum wires 91, 92, are however exposed to an oxidizing environment even within the fused press-seals 61, 62. The electrode arrangement comprises essentially a first electrode 31 and a second electrode 32, between whose opposing tips an arc discharge is excited in the discharge chamber 2, the arc acting as a light source for the high-pressure gas-discharge lamp. The ends of the electrodes 31, 32 are connected to the molybdenum wires 91, 92 via the molybdenum ribbons 81, 82. The molybdenum wires 91, 92 are also connected to the electrical connections (not shown in FIG. 1) of the lamp, via which the supply voltage required to operate the lamp is fed in from a power supply, normally having a ballast, that is designed for a general line-supply voltage.

Situated on the outer surface of the molybdenum ribbons 81, 82 and the molybdenum wires 91, 92 are the coatings 71, 72. The coatings 71, 72 are each composed of two layers.

The outer layer, which is 8 μm thick, is formed from $Al_2O_3$ and the intermediate layer, which is 4 μm thick, is formed from a mixture of nitrides (N) and carbides (C) of titanium (Ti). The quantitative ratio of N to C is selected in such a way that the coefficient of thermal expansion of the intermediate layer assumes a value that is between that of molybdenum (4.8 ppm/K) and that of $Al_2O_3$ (8 ppm/K). The coating with the two layers is performed by a CVD process that is known per se, the molybdenum ribbons 81 and 82 having been connected to molybdenum wires 91 and 92 respectively before the coating process.

Studies of the oxidation resistance of UHP lamps of the above type, having uncoated molybdenum ribbons and molybdenum ribbons that had been coated in accordance with the invention, were carried out as part of an accelerated life test. After 6 hours of tempering at 600° C., the uncoated molybdenum ribbons showed marked features attributable to oxidation; the molybdenum ribbons coated in accordance with the invention on the other hand did not show any.

The invention claimed is:

1. A high-pressure gas-discharge lamp, having at least one gastight fused press-seal between a glasslike material and molybdenum, wherein the molybdenum in the fused press-seal is at least partly exposed to an oxidizing environment and at least that part of the molybdenum that is exposed to the oxidizing environment is covered with a coating, characterized in that the coating comprises at least one oxide from among $Fe_2O_3$, $Ta_2O_5$, $Nb_2O_5$, $Al_2O_3$, $SiO_2$, $TiO_2$, $ZrO_2$, $HfO_2$, and a mixture of at least one nitride and at least one carbide wherein the nitride is selected from TiN, ZrN, HfN, AIN, BN, and wherein the carbide is selected from TiC, ZrC, HfC, VC, NbC, TaC, $B_4C$, and further characterized in that the coating is built up from at least two layers, wherein (i) the layer of the coating that is applied directly to the molybdenum is an intermediate layer composed of the mixture, wherein the mixture is further characterized by nitrides and carbides with a quantitative ratio of nitrides to carbides which results in a coefficient of thermal expansion (CTE) of the intermediate layer having a value that is between that of molybdenum and that of a following layer and (ii) the following layer is composed of an oxide or a plurality of oxides.

2. A high-pressure gas-discharge lamp as claimed in claim 1, characterized in that the coating has a film thickness of from 5 nm to 20 μm.

3. A high-pressure gas-discharge lamp as claimed in claim 1, characterized in that the following layer is composed of $Al_2O_3$.

4. A high-pressure gas-discharge lamp as claimed in claim 1, characterized in that the layer that is applied directly to the molybdenum includes AIN.

5. A high-pressure gas-discharge lamp as claimed in claim 1, characterized in that the size of the fused press-seal in a longitudinal direction is approximately 30 mm.

6. A high-pressure gas-discharge lamp as claimed in claim 1 for use for projection purposes.

7. A lighting device and/or projection device comprising at least one high-pressure gas-discharge lamp as claimed in claim 1.

* * * * *